US006690327B2

(12) United States Patent
McKinzie, III et al.

(10) Patent No.: US 6,690,327 B2
(45) Date of Patent: Feb. 10, 2004

(54) MECHANICALLY RECONFIGURABLE ARTIFICIAL MAGNETIC CONDUCTOR

(75) Inventors: William E. McKinzie, III, Fulton, MD (US); Victor Sanchez, Laurel, MD (US)

(73) Assignee: Etenna Corporation, Laurel, MD (US)

( * ) Notice: Subject to any disclaimer, the term of this patent is extended or adjusted under 35 U.S.C. 154(b) by 0 days.

(21) Appl. No.: 10/246,035

(22) Filed: Sep. 18, 2002

(65) Prior Publication Data

US 2003/0052757 A1 Mar. 20, 2003

Related U.S. Application Data

(60) Provisional application No. 60/323,408, filed on Sep. 19, 2001.

(51) Int. Cl.[7] ..... H01Q 15/02
(52) U.S. Cl. ..... 343/700 MS; 343/756
(58) Field of Search ..... 343/756, 795, 343/700 MS, 909, 910, 787, 833, 754, 755

(56) References Cited

U.S. PATENT DOCUMENTS

| | | | | |
|---|---|---|---|---|
| 4,821,041 | A * | 4/1989 | Evans | 343/700 MS |
| 6,081,235 | A * | 6/2000 | Romanofsky et al. | 343/700 MS |
| 6,195,047 | B1 * | 2/2001 | Richards | 343/700 MS |
| 6,351,240 | B1 * | 2/2002 | Karimullah et al. | 343/700 MS |
| 6,411,261 | B1 * | 6/2002 | Lilly | 343/756 |
| 6,441,787 | B1 * | 8/2002 | Richards et al. | 343/700 MS |
| 6,476,771 | B1 * | 11/2002 | McKinzie, III | 343/756 |
| 6,483,480 | B1 * | 11/2002 | Sievenpiper et al. | 343/909 |
| 6,512,494 | B1 * | 1/2003 | Diaz et al. | 343/909 |
| 6,525,695 | B2 * | 2/2003 | McKinzie, III | 343/756 |

* cited by examiner

*Primary Examiner*—James Clinger
(74) *Attorney, Agent, or Firm*—Brinks Hofer Gilson & Lione

(57) ABSTRACT

In an artificial magnetic conductor, the distance between the frequency selective surface and the ground plane is mechanically varied to adjust the effective inductance or capacitance of the structure and thus the resonant frequency of the device.

52 Claims, 9 Drawing Sheets

MECHANICALLY RECONFIGURABLE ARTIFICIAL MAGNETIC CONDUCTOR

This application claims the benefit of priority to U.S. Provisional Patent Application Ser. No. 60/323,408, filed Sep. 19, 2001, by W. McKinzie et al., entitled "Mechanically Reconfigurable Artificial Magnetic Conductor."

BACKGROUND

The present invention relates generally to reconfigurable high-impedance surfaces. More particularly, the present invention relates to reconfigurable artificial magnetic conductors.

Recent advances in communication technology have lead to the creation of surfaces that approximate perfect magnetic conductors, in which the tangential magnetic field impinging on the surface is forced to be zero. These surfaces, however, only approximate perfect magnetic conductors over a limited band of frequencies, as defined by the ±90° reflection phase bandwidth, and are named artificial magnetic conductors, or AMCs.

An example of a known AMC is shown in FIG. 1. The AMC 100 illustrated in FIG. 1 is fabricated using conventional circuit technology and features an electrically-thin, planar, periodic structure, referred to as a frequency selective surface (FSS) 102. The periodic structure includes capacitive patches 110 that are connected to a conductive ground plane 106 by means of metal vias or posts 108. The posts 108 pass through a spacer layer 104 that consists of a dielectric material having a relatively low permeability. While the spacer layer 104 is typically 10–40 times thicker than the FSS 102, one advantage of AMCs is that the entire structure (FSS, spacer layer, and ground plane) has a much smaller thickness than the free space wavelengths of the frequencies over which the AMC operates, i.e. the wavelength at resonance. In addition, the periodicity of the periodic structure is much smaller than the free space wavelength, typically being 1/12 to 1/40 of the wavelength at resonance.

The resonant frequency of an AMC is defined to be that frequency or frequencies at which the reflection phase angle for a plane wave at normal incidence is zero degrees. For single resonant frequency AMCs as shown in FIG. 1, the resonant frequency is defined as $f_o=1/(2\pi\sqrt{LC})$ where the inductance L is the product of the height of the spacer layer containing the vias times the permeability of the medium which comprises the spacer layer. For simple air filled spacer layers, the inductance may be approximated by $L=\mu_o$ where $\mu_o$ is the permeability of free space, and h is the height of the spacer layer, or the distance between the solid metal conductor of the ground plane and the lower side of the capacitive FSS. The effective sheet capacitance of the FSS is denoted as C, and is measured in Farads per unit square. The resonant frequency of an AMC may be adjusted by varying either or both the inductance and the capacitance of the AMC.

The AMC permits wire antennas to be well matched, in terms of impedance, and radiate efficiently when the antennas are placed in close proximity to the FSS, usually less than 1/100 of the wavelength from the surface. The physical structure of the AMC yields an equivalent transmission line model shown in FIG. 2*a* and the equivalent lumped circuit model shown in FIG. 2*b*. In FIGS. 2*a* and 2*b*, the capacitive FSS is modeled as a shunt capacitance, while the spacer layer is modeled as a transmission line or inductor. These circuit models accurately represent the surface impedance seen by an incident plane wave.

These size reductions are advantageous as most wireless communications applications desire the antenna ground plane to be as small and lightweight as possible so that it may be readily integrated into physically small, lightweight platforms such as radiotelephones, personal digital assistants and other mobile or portable wireless devices. Practically, the relationship between the instantaneous bandwidth of an AMC with a non-magnetic spacer layer and its thickness is given by $$\frac{BW}{f_0} = 2\pi\frac{h}{\lambda_0}$$

where $\lambda_o$ is the free space wavelength at resonance where a zero degree reflection phase is observed. Thus, to support a wide instantaneous bandwidth, the AMC thickness must be relatively large. For example, to accommodate an octave frequency range ($BW/f_0=0.667$), the AMC thickness must be at least $0.106\lambda_o$, corresponding to a physical thickness of 1.4 inches at a center frequency of 900 MHz. This thickness is too large for many practical applications.

Accordingly, there is a need for an artificial magnetic conductor, which allows for a wider frequency coverage for a given AMC thickness than the AMC depicted in FIG. 1. This problem has been addressed in presently pending application Ser. No. 09/845,666 filed Apr. 30, 2001, herein incorporated by reference. In that application, the resonant frequency, $f_o$, of the AMC is electronically adjusted or tuned by controlling the effective sheet capacitance C of its FSS layer. This type of reconfigurable AMC (RAMC) uses integration of varactor or PIN diodes into a single layer FSS where the bias voltage is applied using a resistive lattice which is coplanar with the diode array to adjust the capacitance. Thus, the inter-patch capacitance between the patches is varied in this RAMC. Other RAMCs may change the capacitance of the effective circuit by translating overlapping capacitive patches on different layers and altering the overlap between the two sets of patches.

However, such RAMCs, while having a wide frequency coverage for a given AMC thickness, may have a problem with intermodulation distortion as power levels become significant. Intermodulation distortion is always present when the radio frequency (RF) electronic control devices are used to tune the capacitance in the communication systems. The solid state approaches used above produce intermodulation products in the radiated spectrum when antennas are integrated into RAMCs. It would thus be advantageous to provide an RAMC and that has a broad tuning bandwidth of at least an octave while simultaneously minimizing intermodulation distortion.

BRIEF SUMMARY

In the present RAMC, at least one of the inductance or capacitance is varied. The present RAMC has such a broad tuning bandwidth and minimization of intermodulation distortion. The use of RF electronics is reduced, which permits the device to operate in the presence of high RF fields and currents. In addition, intermodulation products in the RAMC are expected to be very low due to the absence of nonlinear devices.

In a first embodiment, the artificial magnetic conductor (AMC) comprises a ground plane and a frequency selective surface (FSS). The FSS has capacitive patches, at least some of which are electrically connected with the ground plane. The distance between the FSS and the ground plane is variable. The position of one or both of the FSS and ground plane may be adjustable. The distance between the FSS and ground plane may be limited to less than the maximum distance between the FSS and ground plane. The distance between the two may be reversibly varied, varied once and only once, or varied in a single direction. Furthermore, the distance may be varied in discrete amounts or continuously by a linear actuator such as a manually (i.e. by hand not via a motor) or with the aid of a motor.

The AMC may also include spring contact probes or spring tabs, which are used to connect the capacitive patches of the FSS with the ground plane. The spring tabs may be thin, bent in one or more positions, freely or permanently contact the FSS. Threaded shafts may be used to engage with vias in either of the FSS and ground plane to vary the distance between the two. Any movable member (either or both of the FSS and ground plane) may be reinforced by a buttressing mechanism, such as a board stiffener. The board stiffener may be non-metallic. The spacer layer between the FSS and ground plane may be filled substantially with air or a dielectric having a relatively low permittivity.

In a second embodiment, the equivalent transmission line circuit of the AMC has an inductor of variable inductance in parallel with a capacitor. The conductor may have a constant capacitance. The inductance may be defined by a permeability multiplied by a multiplier. The permeability may be constant while the multiplier is variable. The resonant frequency of the AMC may be adjustable over at least a 3:1 or about a 10–15% tuning ratio by varying the inductance. The inductance may be either continuously variable or variable by discrete amounts. Further, the inductance may be either reversibly variable, variable once and only once, or variable only in a single direction, increasing or decreasing.

In a third embodiment, the AMC contains the ground plane and two FSS layers. At least one of these is movable and at least one has a constant position. As in the above embodiments, the FSS layers have at least one set of capacitive patches associated with each layer. This is to say that one or more of the FSS layers may have multiple layers of capacitive patches disposed at different positions on that FSS (most frequently opposing surfaces).

In a fourth embodiment, a method of effecting a broad tuning bandwidth of at least an octave while simultaneously minimizing intermodulation distortion in an AMC comprises varying a distance between a ground plane and a FSS of the AMC.

In a fifth embodiment, a method of effecting a broad tuning bandwidth of at least an octave while simultaneously minimizing intermodulation distortion in an AMC an equivalent transmission line circuit comprises varying an inductance of the equivalent lumped circuit model of the AMC.

Many different devices and communication systems may use the AMCs described above, for example: an antenna, a telephone, a personal digital assistant, a portable wireless device, or a computer.

DETAILED DESCRIPTION OF PREFERRED EMBODIMENTS

The embodiments of a reconfigurable artificial magnetic conductor (RAMC) described here allow a broader frequency coverage than a passive artificial magnetic conductor (AMC) by varying the associated inductance or capacitance of its equivalent transmission line circuit in a controlled way to adjust the resonant frequency. Approaches for tuning the inductance include moving either the ground plane or frequency selective surface (FSS) mechanically.

Figure 9:
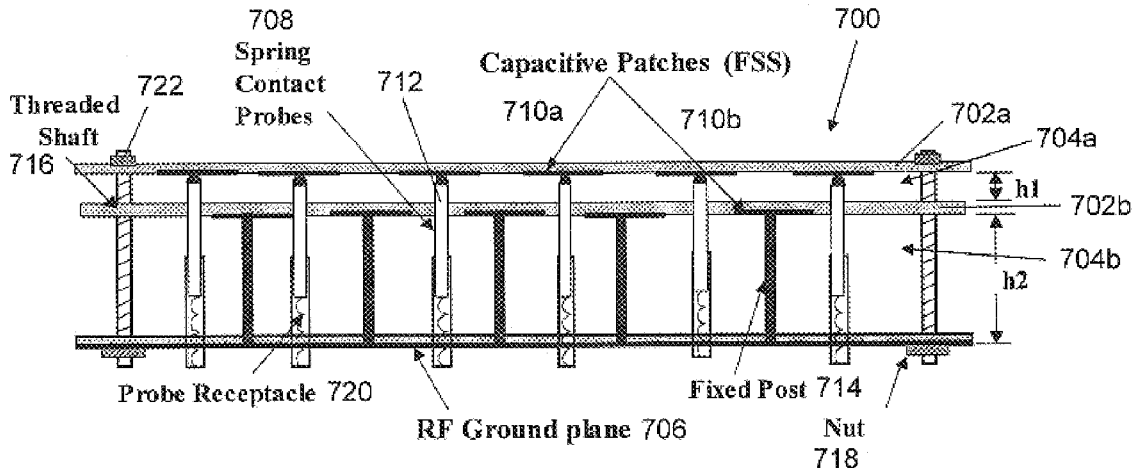
FIG. 9 is a cross-sectional view of the RAMC of a fourth embodiment.
Figure 10:
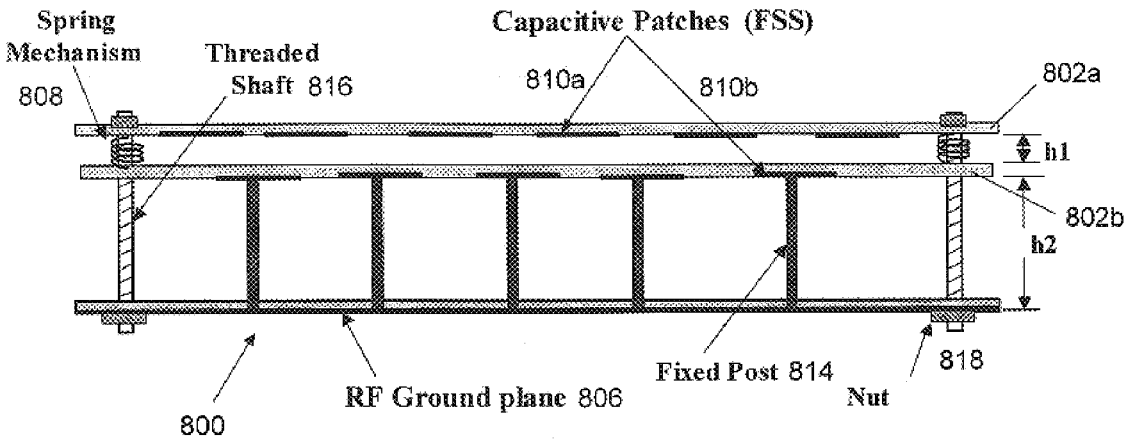
FIG. 10 is a cross-sectional view of the RAMC of a fifth embodiment.

One advantage of a mechanically reconfigurable AMC (RAMC) is that it permits adjacent wire or strip antenna elements to radiate efficiently over a relatively broad tunable bandwidth, of at least approximately 3:1 in resonant frequency, when the elements are placed in close proximity to the RAMC surface (as little as $\lambda_0/200$ separation where $\lambda_o$ is the AMC resonant wavelength). A linear actuator provides an additional advantage, varying the resonant frequency linearly with changes in the physical characteristics of the RAMC. The bandwidth can be tuned by adjusting the position of one or more layers of the structure, thereby altering the distance between layers and consequently changing either or both the effective inductance and capacitance of the structure. FIGS. 4–8 illustrate embodiments in which the effective inductance is changed, while FIGS. 9–10 show embodiments in which the effective capacitance is altered.

Figure 1:
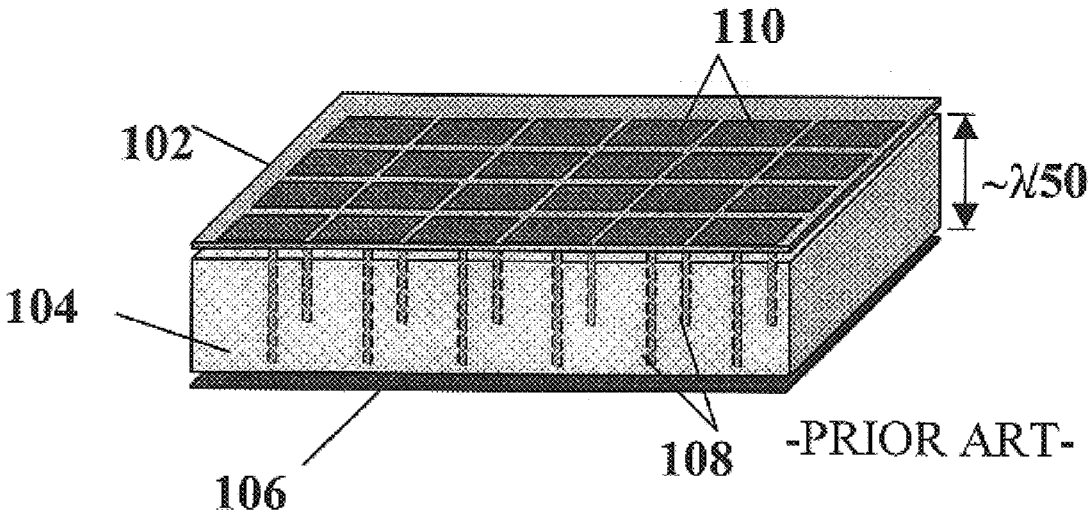
FIG. 1 is a cross-sectional view of a conventional AMC.
Figure 2A:
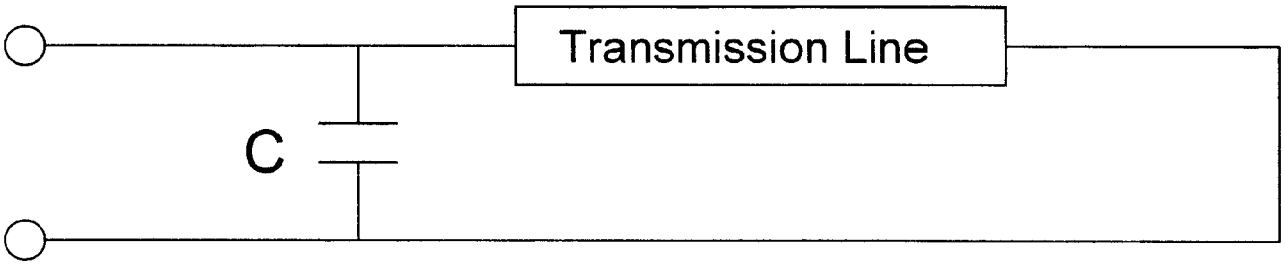
FIGS. 2*a* and 2*b* illustrate an equivalent transmission line and circuit of the structure of FIG. 1.
Figure 2B:
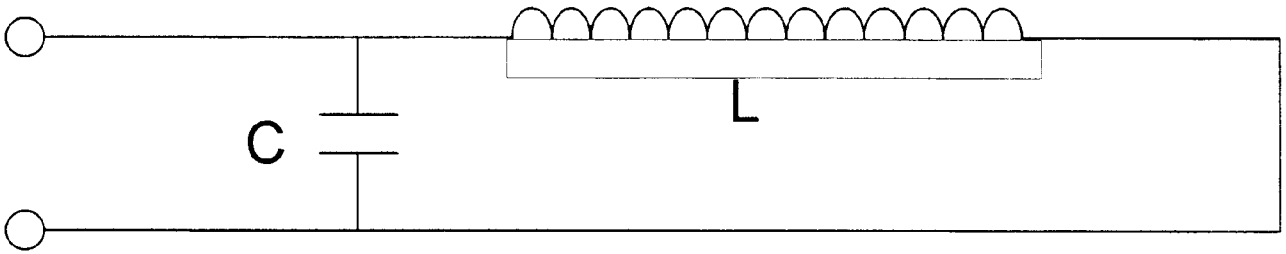
Figure 3:
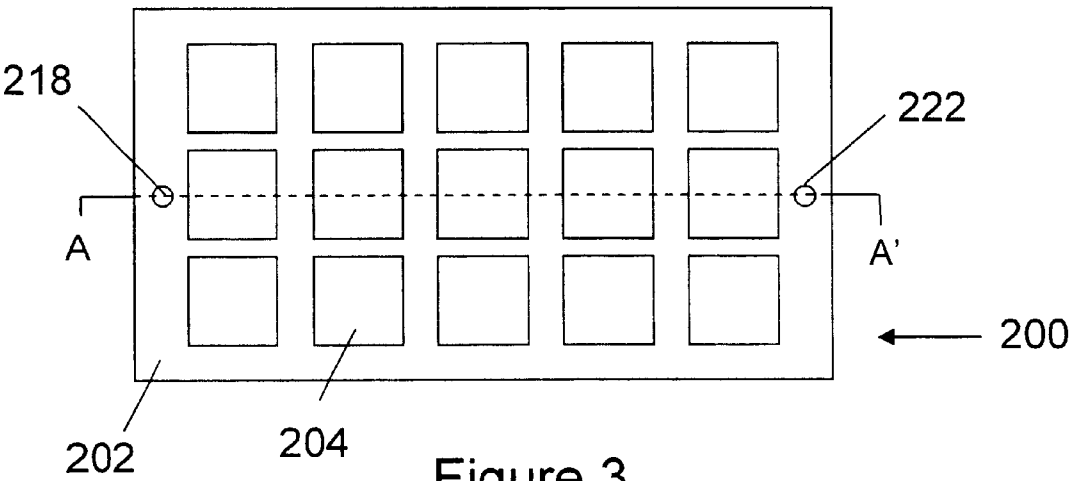
FIG. 3 is a top view of the RAMC of the first embodiment.
Figure 4:
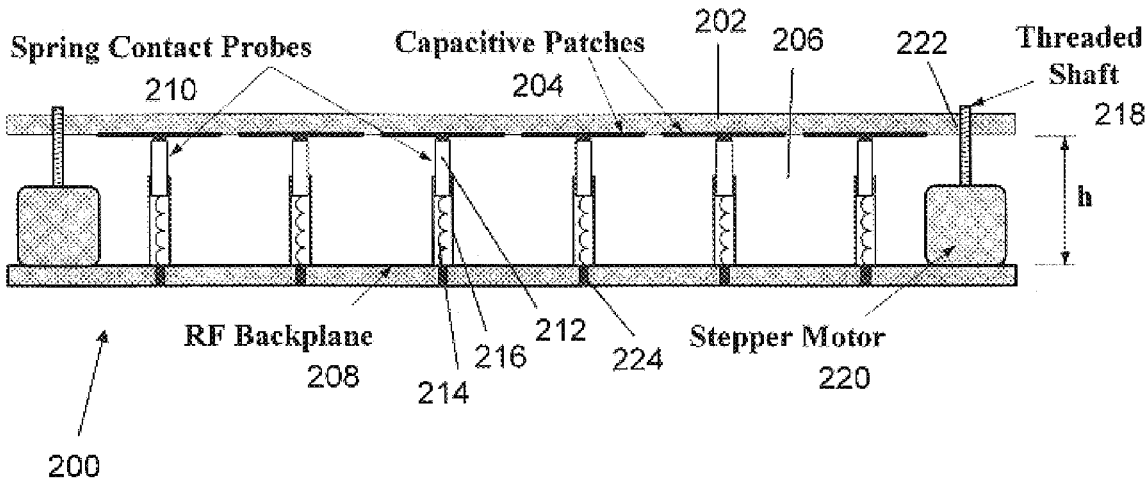
FIG. 4 is a cross-sectional view of the RAMC of the first embodiment.

FIGS. 3 and 4 show a top and cross-sectional view, respectively, of one embodiment of a RAMC 200. FIG. 4 is a cross sectional view of the RAMC 200 taken along line A–A' in FIG. 3. The RAMC 200 has a FSS 202 with a periodic structure of capacitive patches (or conductive patches) 204, which is usually a two dimensional array. The FSS 202 may be fabricated from a circuit board and the capacitive patches 204 are formed of a conductive material, e.g. metal such as copper or metal alloys. The capacitance of the FSS 202 may be constant. The term FSS as used herein includes the substrate on which the capacitive patches are disposed. This substrate is typically a printed circuit board substrate well known in the art. Although only a single layer of capacitive patches 204 are shown, multiple layers of capacitive patches may also be used to increase the capacitance, as shown in FIGS. 9 and 10 and described later (and also discussed in the application incorporated by reference). Furthermore, the FSS 202 contains threaded vias. These vias may be threaded holes, PEM nuts, or other threaded inserts or fasteners, which are anchored to the printed circuit substrate. Thus, an FSS assembly may include one or more layers of capacitive patches in addition to threaded vias that permit mechanical attachment and vertical movement of the FSS assembly. The terms FSS and FSS assembly are used interchangeably herein.

The RAMC 200 also includes a spacer layer 206, a ground plane (or RF backplane) 208 and conductive posts 210. The spacer layer 206 separates the FSS 202 and the ground plane 208. The spacer layer 206 may comprise a dielectric material having any suitable permittivity. Preferably, the spacer layer 206 is air filled, although a material such as foam may alternatively be used. A solid material filling the spacer layer 206 may serve to increase stabilization of the overall RAMC structure against environmental factors such as vibration or temperature variation. A relatively low permittivity layer is preferred because, for a given physical thickness (i.e. bandwidth) a lower dielectric constant substrate will help reduce the propensity of the structure to guide TE surface waves and thus will help ensure a full TE bandgap. In general, a dielectric with a permittivity preferably below approximately 6 is used. The ground plane 208 has at least one layer that is continuous and fabricated from a conductive material, e.g. an appropriate metal such as aluminum.

The conductive posts 210 are preferably formed from metal or a metal alloy and electrically connect the capacitive patches 204 with the ground plane 208 through an air-filled or other low permittivity dielectric-filled spacer layer 206. The use of a metal permits adequate electrical connection along with ease of temporary connection or permanent attachment. Each post 210 is associated with a patch 204 of the FSS 202 and may be a spring contact probe, as shown, which is adjustable in height. The spring contact probes 210 electrically connect the FSS 202 with the ground plane 208. Each spring contact probe 210 includes a probe tip 212 and a spring 214 housed in a probe receptacle 216. While FIG. 4 shows that the probe receptacles 216 are soldered or otherwise attached into through holes 224 in the ground plane 208, they may also be installed upside down to this, i.e. such that the barrel or receptacle 216 is soldered to the FSS 202. Similarly, the probe tip 212 may be either temporarily connected with the patch 204 through the force of the spring or may be permanently attached, such as by soldering. Soldering may be facilitated by a plated through hole (not shown) in the FSS.

Typical spring contact probes 210 in the RAMC 200 have a length between 0.5" and 1.5", which are appropriate for VHF and UHF frequency RAMCs, and may be supplied by Interconnect Devices, Inc. or Coda Systems, for example. Such probes have a collapsed length of about 70–80% of the extended length, thereby limiting the minimum distance between the FSS 202 and the ground plane 208. Although a specific ratio of the collapsed/extended length of the probes is given, it is merely exemplary; the ratio may be any ratio dependent on the particular probe used.

Figure 5:
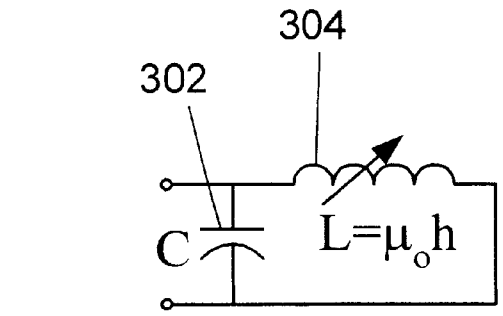
FIG. 5 illustrates an equivalent lumped circuit model of the RAMC of FIGS. 3 and 4.

The RAMC 200 has the equivalent transmission line circuit 300 shown in FIG. 5. This circuit 300 includes a capacitance 302 and an inductance 304 in parallel with the capacitance 302. The circuit 300, and thus RAMC 200, has a resonant frequency defined by the parallel combination of the capacitance 302 and inductance 304. The capacitance 302 models effective sheet capacitance of the FSS 202 and the inductance 204 models the effective inductance of the spacer layer 204 containing the spring contact probes 210. The inductance 304 is defined by the permeability of the spacer layer 206 multiplied by the height of the spring contact probes 210. Thus, the inductance 304 is variable because the height of the spring contact probe 210 is variable, while the capacitance 302 is constant and, in this embodiment, the variation in the resonant frequency of the RAMC 200 is controlled substantially solely by the height of the spring contact probe 210. As above, the reduction in AMC resonant frequency for the compressed spring contact probes 210 is about 10–15% of the maximum frequency when the spring contact probes 210 are extended. The dimensions of the RAMC 200 including those of the periodic structure may be chosen such that the resonant frequency is in the VHF, UHF, L-band, or any other band as desired. As an example, a typical RAMC operating in the UHF band may have a nominal surface area of about 200–400 in. sq. and may have dozens, hundreds or more spring contact probes.

In the first embodiment, as illustrated in FIG. 4, threaded shafts 218 are engaged with threaded holes 222 in the FSS 202 to adjust the distance (height) between the FSS 202 and the ground plane 208. As described above, threaded inserts could be pressed into drilled holes in the FSS 202 rather than the threaded holes 222 in order to form the threaded vias that engage the threaded shafts 218. By rotating the threaded shafts 218, the FSS 202 is reversibly moved either toward or away from the ground plane 208 as desired. The threaded holes 222 go all the way through the entire circuit board that comprises the FSS 202 such that the threaded shafts 218 may protrude from the threaded holes 222, dependent on the distance h between the FSS 202 and the ground plane 208.

A miniature motor 220, such as a stepping motor, is attached to the ground plane 208 and rotates the threaded shafts 218. The motor 220 is disposed between the FSS 202 and the ground plane 208 but is not taller than the probe receptacle 214 so that the spring contact probe 210 can be recessed by the maximum amount. The motor 220 is controlled by external control elements (not shown). For example, the RAMC 200 may be integrated with a radio transceiver which controls tuning, reception and transmission of radio signals through an antenna (not shown) formed in part by the RAMC 200. As part of the tuning process, which selects a frequency for reception or transmission, a control circuit (not shown) applies appropriate signals to control the inductance of the RAMC 200, which in turn controls the resonant frequency of the RAMC 200. Although a stepping motor has been mentioned as an actuator, other linear actuators, such as a pancake motor, or may also be used.

In alternate embodiments, screws, scissor jacks, or other comparable mechanisms may replace the threaded shafts 218 and the motor 220 eliminated. In some of these cases, the threaded vias may not be necessary, e.g. the top of the screw or scissor jack disposed on the bottom of the movable FSS, which would decrease assembly time and expense. In these embodiments, the screws, for example, are linear actuators that are manually operated by hand rather than motorized. One such embodiment (not shown), the distance between the FSS 202 and the ground plane 208 may not be reversible. This is to say that the distance between the two may be adjusted once and only once, a single permanent adjustment to set the resonant frequency of the RAMC 200. Alternatively, the distance may be adjusted in only one direction, increasing or decreasing, corresponding to the FSS 202 moving away from or towards the ground plane 208. In either of these cases, the FSS 202 may be permanently deformed to set the frequency of the RAMC 200.

Other embodiments may include RAMCs in which the distance is varied in discrete amounts rather than being varied continuously. This may have advantages in speed and convenience in tuning from one frequency to another, for example from one frequency band to another. Numerous ways are known in the art to effect discrete limitations on the distance and will not be described here for brevity.

In the above embodiments, the position of the FSS 202 is adjusted while the ground plane 208 remains unmoved. In other embodiments, the position of the ground plane may be varied while the position of the FSS remains constant or both may be varied. One example of an embodiment in which the position of the ground plane is varied is shown in FIG. 6.

Figure 6:
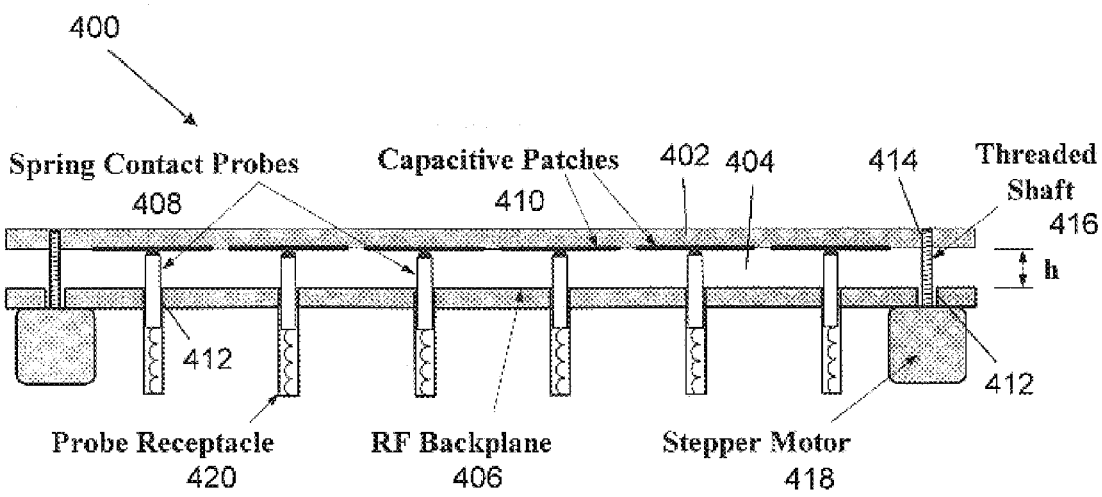
FIG. 6 is a cross-sectional view of the RAMC of the second embodiment.

In the RAMC 400 of FIG. 6, the materials that comprise the RAMC 400 remain essentially the same as those of the embodiments above. The FSS 402 has threaded holes 414 that engage with the threaded shafts 416 but may not pass all the way through the top of the FSS 402. The spacer layer 404 separates the FSS 402 from the ground plane 406 and the spring contact probes 408 electrically connect the capacitive patches 410 of the FSS 402 with the RF backplane 406. The ground plane 406 has unthreaded holes 412 through which the threaded shafts 416 pass and which are larger than the threaded shafts 416. The miniature motor 418 to which the threaded shafts 416 are connected is disposed below the ground plane 406, i.e. on the opposite side of the ground plane 406 from the FSS 402.

The probe receptacles 420 of the spring contact probes 408 are press fit into some of the holes 412 in the ground plane 406. The probe receptacles 420 may also be soldered, conductive glued, screwed, or bayonet mounted into the holes 412, for example. The holes 412 in the ground plane 406 may be fabricated similar to the holes 414 in the FSS 402 by drilling or any other conventional manner. The probe receptacles 420 are fit into the holes 412 in the RF backplane 406 such that the apertures of the probe receptacles 420 are substantially flush with the upper surface of the ground plane 406. The probe receptacles 420 protruding from the lower surface of the ground plane 406, in conjunction with the motor 418 being disposed below the ground plane 406, permit the height of the spring contact probes 408 to be reduced to approximately zero, i.e. the FSS 402 to physically contact or come extremely close to physically contacting the ground plane 406. Correspondingly, the spacer layer 404 decreases as the height decreases, as does the inductance of the effective circuit above. This, in turn, allows the distance between the FSS 402 and the ground plane 406 to be varied over at least a 10:1 ratio while maintaining the compactness of the RAMC 400. The variation in distance corresponds to at least a 3:1 tuning ratio of the RAMC resonant frequency. One disadvantage of this RAMC 400 as compared with the RAMC of the first embodiment, however, is that the total thickness is larger than that of the RAMC 200 of the first embodiment due to the probe receptacles 420 protruding from the lower surface of the ground plane or RF backplane 406.

Similar alternate embodiments as those described above may also be used, e.g. screws replacing the threaded shafts 416 and the motor 418/motor controller eliminated, the distance adjusted once and only once or in only one direction, the distance being varied by discrete amounts rather than continuously.

Figure 8:
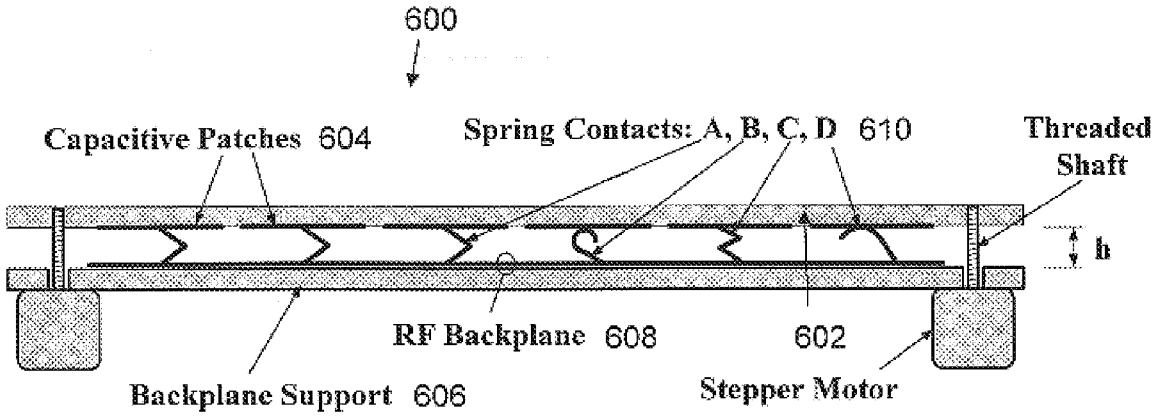
FIG. 8 is a cross-sectional view of the RAMC of the third embodiment.

Another embodiment for a mechanically RAMC 600 is shown in FIG. 8. In this embodiment, a thin sheet 608 of spring metal, such as Beryllium Copper, is stamped such that spring tabs 610 protrude from one side of the sheet. These spring tabs 610 are flexible and form the electrical connections between the ground plane 612 and the capacitive patches 604 on the bottom of the FSS layer 602. The thin sheet 608, backed up by a mechanical supporting structure 606, becomes the ground plane 612 (or RF backplane). The mechanical supporting structure 606 (or backplane support) that supports the thin sheet 608 may be almost any rigid surface whose upper surface is conductive, such as an aluminum sheet. The rigid conducting surface 606 may be substantially planar, but it is not necessary that this be the case.

As shown in FIG. 8, the spring tabs 610 may have any number of shapes so long as they are in electrical contact with the patches 604 of the FSS layer 602. Although four different shapes are depicted in FIG. 8, many others are possible. The spring tabs 610, like the above probe tips, may be temporarily connected with or permanently attached to the capacitive patches 604. This is to say that the electrical contact of the spring tabs 610 to the capacitive patches 604 may be established through spring contact (i.e. freely/removably) or may be permanently affixed, e.g. by solder. Permanent contact may be accomplished by a surface mounting operation or by inserting tabs into plated through holes. While the surface mounting technique may be the simplest and cheapest, fatigue/reliability issues at the solder junction may prohibit this method to being used for a RAMC that is varied once and only once. In either case, the spring tabs 610 contact substantially the center of the capacitive patches 604. Preferably, the spring tabs 610 are relatively narrow with respect to the length of the spring tabs 610 and contain at least one bend at a position intermediate between the ends of the spring tab such that the total height of the spring tabs is adjustable with minimal applied compressive force. A rigid conductive support structure is used to back the stamped metal and to allow transfer of compressive force to the spring tabs 610. The distance between the FSS 602 and ground plane 612 can be adjusted with a variety of mechanical approaches described above.

While the capacitive patches in the previous embodiments are arranged in a regular pattern and the patches themselves are substantially square in shape, as shown in FIG. 3, the pattern of the patches as well as the patch shape is not limited thereto. For example, substantially circular, hexagonal, diamond, or triagonal patch shapes may be used. Changing the size of patches and/or the periodicity, will change the TM mode cutoff frequency, resulting in a larger or smaller surface wave bandgaps. Particular geometrical configurations may be chosen to optimize performance factors such as resonance frequency or frequencies, size, weight, and so on. In addition, while the FSS of the above embodiment may be manufactured using a conventional printed circuit board process to print the patches on one or both surfaces of the FSS, other manufacturing technology may be substituted for this process. Furthermore, although the above embodiments describe embodiments in which the position of only one of the FSS and ground plane may be adjusted, other embodiments are possible in which the positions of both of the layers are varied.

The present embodiments describe RAMCs whose surface impedance is isotropic for both transverse polarizations of electric fields due to the symmetry of the patches. It is possible to spoil this symmetry (ignoring edge effects), for example by employing rectangular patches in place of square patches. Such asymmetry can cause the AMC resonance to be polarization specific, but the AMC will still exhibit properties of a high impedance surface, and it will still be tunable. However, the surface wave bandgap may be adversely affected, or even disappear.

Figure 7:
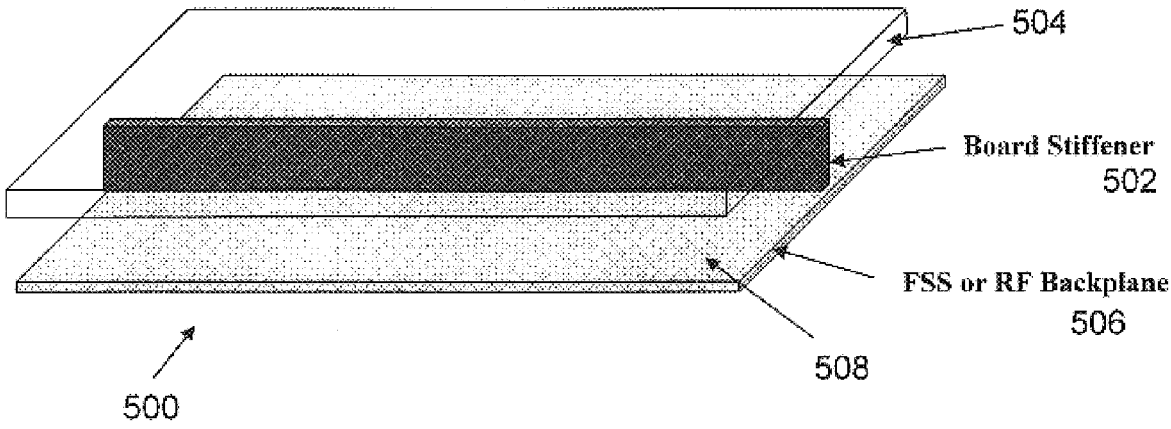
FIG. 7 is a partial view of the RAMC of the third embodiment.

In general, another mechanical engineering challenge lies in the fact that it is difficult to maintain a flat surface when the force generated by the collapsed spring contact probes is applied between the FSS and RF backplane layers. This is especially true as the typical RAMC will have dozens and perhaps hundreds of spring contact probes that create bending moments in the FSS and RF backplane layers, causing the layers to bow. A non-uniform distance between the FSS and ground plane causes non-uniformity in the resonant frequency of the structure, thus potentially degrading performance. FIG. 7 illustrates one solution to this problem: an RAMC 500 employing a board stiffener 502 to reduce the bending of the FSS 504 and ground plane 506. The spring contact probes and other features of the RAMC 500 have been omitted for clarity. The board stiffener 502 may be soldered to the FSS 504 or ground plane 506 using mounting tabs (not shown) in the board stiffener 502 and matched through holes in the layer (not shown). Similarly the board stiffener 502 may be attached/mounted in any other similar fashion.

In one example, a commercially available lightweight metal (e.g. aluminum) diaphragm may be used as the board stiffener 502 if disposed below the RF backplane 506. However, if the board stiffener 502 stiffens either the FSS 504 or stiffens the ground plane 506 and is disposed in the spacer layer 508, non-metallic materials must be used for the board stiffener 502 to avoid perturbing the electromagnetic fields in the spacer layer 508. In this case, the stiffener may be fabricated from conventional PC board material in which the metal has been etched away. Note that although not shown, multiple stiffeners of different materials may be used to reinforce the different layers. As before, the stiffeners may be disposed within the spacer layer 508 (on the inner surfaces of the layers), thereby limiting the range of height variation but reducing the overall thickness of the structure, or may be disposed on the outer surfaces of the layers, thereby increasing the overall thickness of the structure but allowing a greater ratio of tuning since the height may be decreased to a smaller value.

FIG. 9 shows a cross-sectional view of a fourth embodiment of a RAMC 700. While the materials that comprise the RAMC 700 remain essentially the same as those of the embodiments above, the structure is somewhat different. In this embodiment, a first set of capacitive patches 710*a* is disposed on the lower surface of a first FSS 702*a* and a second set of capacitive patches 710*b* is disposed on the lower surface of a second FSS 702*b*. The first and second set of capacitive patches 710*a* and 710*b* overlap, thereby forming a capacitance between the two FSS layers that is in general substantially larger than the planar capacitance produced by the particular array of capacitive patches on either FSS layer alone.

A first spacer layer 704*a* of height h1 separates the upper and lower FSS 702*a* and 702*b* from each other while a second spacer layer 704*b* of height h2 separates the lower FSS 702*b* from the ground plane 706 (or RF backplane). The first and second spacer layers 704*a* and 704*b* are formed from the same type of materials as the spacer layer in the previous embodiments. Fixed posts 714, whose height is not adjustable, electrically connect the capacitive patches 710*b* of the lower FSS 702*b* with the RF backplane 706. Spring contact probes 708 electrically connect the capacitive patches 710*a* of the upper FSS 702*a* with the RF backplane 706. As above, the height of the spring contact probes 708 is adjustable. In the embodiment shown in FIG. 9, only the position of the upper FSS 702*a* is adjustable and thus the distance between the upper and lower FSS 710*a* and 710*b* (and capacitive patches disposed thereon) is adjustable. The lower FSS 704*b* contains via holes (not shown) that are larger than the tips 712 of the spring contact probes 708 and through which the tips 712 of the spring contact probes 708 pass.

The spring contact probes 708 are essentially the same as those of previous embodiments, e.g. having a probe receptacle 720 and a tip 712 that is temporarily connected with or permanently affixed to the first set of capacitive patches 710*a*. The fixed posts 714 are formed from the same types of material as the spring contact probes 708, e.g. metal or a metallic alloy. The fixed posts 714 contact the second set of capacitive patches 710*b* substantially at the center of the second set of capacitive patches 710*b*, similar to the spring contact probes 708, which contact the first set of capacitive patches 710*a* substantially at the center of the first set of capacitive patches 710*a*.

The ground plane 706 and lower FSS 702*b* have unthreaded holes (not shown) through which threaded shafts 716 pass and which are larger than the threaded shafts 716. The upper FSS 702*a*, on the other hand, has threaded holes (not shown) fitted to and in contact with the threaded shafts 716 and through which the threaded shafts 716 pass. A nut 718, to which the threaded shaft 716 is connected, is disposed below the ground plane 706, i.e. on the opposite side of the ground plane 706 from the FSS 702*a* and 702*b*. The nut 718 is turned to adjust the position of the upper FSS 702*a*. Another nut 722 is used to limit the range of motion of the upper FSS 702*a*, i.e. the FSS 702*a* is limited to a distance of not larger than h1 from the lower FSS 702*b*.

The threaded shafts 716, as well as the nuts 718 and 722, may be formed from any suitable material, conductive (such as metal) or non-conductive (such as resin), as long as the motion of the shaft 716 adjusts the distance between the upper and lower FSS 702*a* and 702*b*. The threaded shafts 716 and nut 722 do not contact the capacitive patches on either the upper or lower FSS 702*a* or 702*b*.

As shown, the capacitive patches are disposed on the lower surface of each FSS. However, placement of the capacitive patches on the lower surface of the FSS is not required; the capacitive patches may be disposed on the upper surface of either (or both) FSS. One benefit of an embodiment in which capacitive patches are disposed on the upper surface of the lower FSS and on the lower surface of the upper FSS as opposed to an embodiment in which capacitive patches are disposed on the same surface of both the lower and upper FSS is that the effective capacitance is increased for the same structure. This, in turn, decreases the resonant frequency of the overall RAMC or permits the size of the RAMC to be changed correspondingly to achieve the same frequency.

Similarly, although only one surface of each FSS contains capacitive patches, capacitive patches may be present on both surfaces of either (or both) FSS or buried in the structure supporting the FSS (e.g. the printed circuit board). Multiple layers of capacitive patches that are disposed at different vertical positions have the advantage of creating multiple resonant frequencies as described more fully in the application incorporated by reference.

Also, the lower FSS, rather than the upper FSS, may be connected with the RF backplane through adjustable spring contact probes while the upper FSS, rather than the lower FSS may be connected with the RF backplane through fixed posts. Further, the number of fixed posts may be reduced or the fixed posts may be eliminated altogether and a solid dielectric spacer layer used instead. The latter arrangement is also called a thinned-via array and may provide more mechanical stability than using fixed posts.

Similar alternate embodiments as those described above may also be used, e.g. screws replacing the threaded shafts 416 and the motor 418/motor controller eliminated, the distance adjusted once and only once or in only one direction, the distance being varied by discrete amounts rather than continuously.

Another RAMC 800 having multiple FSS layers is shown in FIG. 10. This embodiment is a thinned-via RAMC that is similar to the previous RAMC 700, with one important difference. In the RAMC 800 of FIG. 10, the spring contact probes are replaced by spring mechanisms 808 that surround the threaded shafts 816 and are disposed between the upper and lower FSS 802*a* and 802*b*. As shown, the first set of capacitive patches 810*a* is left floating (i.e. at a floating potential or non-grounded) while the second set of capacitive patches 810*b* is connected to the RF backplane 806 through the fixed posts 814. Advantages of such an arrangement include a decrease in material costs as a few simple spring mechanisms 808 are used replace a large number of spring contact probes as well as a decrease in fabrication costs as no soldering or permanent fixture is required, nor is attachment of the probe receptacle to the RF backplane 806. Although only two threaded shafts are illustrated in FIG. 10, being disposed at the border of the RAMC 800, the threaded shafts may be disposed at regular intervals throughout the RAMC to prevent significant flexure in the substrate containing the upper FSS. Similarly, the nuts 818 used to adjust the height may be replaced by a motor such as a stepper motor.

As above, various modifications may be made to the arrangement of FIG. 10.

From the foregoing, it can be see that the present invention provides a reconfigurable artificial magnetic conductor (RAMC) that allows for wide frequency coverage, while the mechanical approach to tuning the RAMC permits linear response and the accommodation of high RF power levels without substantial intermodulation distortion. The inductance in the equivalent circuit of the RAMC is controlled, thus controlling its high impedance properties. In different embodiments the probe receptacles of the spring contact probes are disposed either within the spacer layer or below the RF backplane. In the former case, the overall thickness of the RAMC is decreased, while in the latter case the range of variation of the thickness is increased.

The AMC may be part of an antenna. Such an antenna may be used in a communication system in portable electronics, for example a telephone, personal digital assistant, portable wireless device or computer. For instance, a printed monopole antenna may be located on the upper surface of FSS layers 702*a* or 802*a* in FIG. 9 or 10.

While particular embodiments of the present invention have been shown and described, modifications may be made. It is therefore intended in the appended claims to cover such changes and modifications which follow in the true spirit and scope of the invention.

We claim:

1. An artificial magnetic conductor (AMC) comprising:

a conductive ground plane; and a frequency selective surface (FSS) containing a layer of capacitive patches electrically connected with the ground plane, the FSS disposed a variable distance from the ground plane.

2. The AMC of claim 1, wherein spring contact probes connect the capacitive patches with the ground plane.

3. The AMC of claim 2, further comprising threaded shafts engageable with threaded vias in the FSS, the threaded shafts rotated to vary the distance between the FSS and the ground plane.

4. The AMC of claim 3, wherein the spring contact probes comprise probe receptacles and are attached to the ground plane via the probe receptacles such that the variation of distance between the FSS and the ground plane is limited by the probe receptacles.

5. The AMC of claim 3, wherein the spring contact probes comprise probe receptacles, which are installed into receptacle holes in the ground plane such that an aperture of the receptacle holes is substantially flush with a surface of the ground plane.

6. The AMC of claim 1, wherein the distance is adjustable only a single time.

7. The AMC of claim 1, wherein the distance is adjustable in only a single direction.

8. The AMC of claim 1, further comprising a buttressing mechanism attached to one of the ground plane and the FSS to reinforce the one of the ground plane and the FSS.

9. The AMC of claim 1, further comprising a reversible moving mechanism to reversibly alter the distance between the ground plane and the FSS.

10. The AMC of claim 1, wherein the distance is continuously altered.

11. The AMC of claim 1, wherein the distance is altered in discrete amounts.

12. The AMC of claim 1, wherein the distance between the ground plane and FSS is substantially air-filled.

13. The AMC of claim 1, wherein the distance between the ground plane and FSS is substantially filled with a dielectric material having a relatively low permittivity.

14. The AMC of claim 1, wherein one of the FSS and ground plane is movable and the other of the FSS and ground plane is immobile.

15. The AMC of claim 1, wherein both of the FSS and ground plane are movable.

16. The AMC of claim 1, wherein the distance is varied by a linear actuator.

17. The AMC of claim 1, wherein the ground plane comprises a thin sheet of conductive spring material, a mechanical supporting structure that supports the thin sheet, and spring tabs extending from the thin sheet of conductive spring material and contact the capacitive patches.

18. The AMC of claim 17, wherein the spring tabs are relatively narrow with respect to a length of the spring tabs.

19. The AMC of claim 17, wherein each of the spring tabs contain at least one bend at a position intermediate between ends of the spring tab.

20. An artificial magnetic conductor (AMC) comprising:

a conductive ground plane;

a first frequency selective surface (FSS) containing a first set of capacitive patches and disposed a variable distance from the ground plane; and a second FSS containing a second set of capacitive patches disposed a constant distance from the ground plane, the second set of capacitive patches electrically connected with the ground plane.

21. The AMC of claim 20, wherein the second FSS is disposed more proximate to the ground plane than the first FSS.

22. The AMC of claim 20, wherein the second set of capacitive patches is connected with the ground plane.

23. The AMC of claim 20, wherein the second set of capacitive patches is unconnected with the ground plane.

24. The AMC of claim 22, wherein spring contact probes connect the second set of capacitive patches with the ground plane.

25. The AMC of claim 20, further comprising threaded shafts engageable with threaded vias in the first FSS, the threaded shafts rotated to vary the distance between the first FSS and the ground plane.

26. The AMC of claim 20, wherein the variable distance is adjustable only a single time.

27. The AMC of claim 20, wherein the variable distance is adjustable in only a single direction.

28. The AMC of claim 20, further comprising a reversible moving mechanism to reversibly alter the variable distance between the ground plane and the FSS.

29. The AMC of claim 20, wherein the variable distance is continuously altered.

30. The AMC of claim 20, wherein the variable distance is altered in discrete amounts.

31. The AMC of claim 20, wherein the ground plane comprises a thin sheet of conductive spring material, a mechanical supporting structure that supports the thin sheet, and spring tabs extending from the thin sheet of conductive spring material and contacting one of the first and second set of capacitive patches.

32. The AMC of claim 31, wherein the spring tabs are relatively narrow with respect to a length of the spring tabs.

33. The AMC of claim 20, wherein the first and second set of capacitive patches overlap.

34. The AMC of claim 20, wherein one of the first and second FSS contains a third set of capacitive patches disposed at a different vertical position.

35. A method of effecting a broad tuning bandwidth of at least an octave while simultaneously minimizing intermodulation distortion in an artificial magnetic conductor (AMC), the method comprising mechanically varying a distance between a first frequency selective surface (FSS) and a ground plane.

36. The method of claim 35, further comprising moving the ground plane and maintaining a position of the first FSS.

37. The method of claim 35, further comprising moving both the first FSS and the ground plane.

38. The method of claim 35, further comprising electrically connecting at least some of capacitive patches on the first FSS with the ground plane.

39. The method of claim 35, further comprising engaging threaded shafts with the first FSS and the ground plane and rotating the threaded shafts to vary the distance therebetween.

40. The method of claim 35, further comprising continuously varying the distance.

41. The method of claim 35, further comprising discretely varying the distance.

42. The method of claim 35, further comprising reversibly varying the distance.

43. The method of claim 35, further comprising permanently varying the distance the first and only time the distance is varied.

44. The method of claim 35, further comprising varying the distance only in one direction.

45. The method of claim 35, further comprising filling a volume between the ground plane and the first FSS substantially with one of air and a dielectric of a low permittivity.

46. The method of claim 35, further comprising establishing a constant position of a second FSS having capacitive patches that overlap capacitive patches of the first FSS.

47. The method of claim 46, further comprising varying the distance between the first FSS and both the ground plane and the second FSS.

48. The method of claim 47, further comprising electrically connecting capacitive patches on the second FSS with the ground plane.

49. The method of claim 48, further comprising electrically connecting capacitive patches on the first FSS with the ground plane.

50. The method of claim 35, further comprising forming spring tabs from a thin sheet of conductive material that forms the ground plane, supporting the thin sheet, and electrically connecting capacitive patches on the first FSS with the thin sheet via the spring tabs.

51. The method of claim 46, further comprising forming spring tabs from a thin sheet of conductive material that forms the ground plane, supporting the thin sheet, and electrically connecting capacitive patches on the second FSS with the thin sheet via the spring tabs.

52. The method of claim 50, further comprising limiting a width of the spring tabs to being relatively narrow with respect to the distance between the first FSS and ground plane.

* * * * *